US005127192A

United States Patent [19]

Cross

[11] Patent Number: 5,127,192

[45] Date of Patent: * Jul. 7, 1992

[54] PIVOT SHOE FOR REMOVABLE SASH

[76] Inventor: Rex D. Cross, No. 1 Old Church Rd., Greenwich, Conn. 06830

[ * ] Notice: The portion of the term of this patent subsequent to Sep. 25, 2007 has been disclaimed.

[21] Appl. No.: 741,380

[22] Filed: Aug. 7, 1991

[51] Int. Cl.[5] ..... E05D 15/22

[52] U.S. Cl. ..... 49/181; 49/453

[58] Field of Search ..... 49/181, 453

[56] References Cited

U.S. PATENT DOCUMENTS

| | | | |
|---|---|---|---|
| 3,482,354 | 12/1969 | Trout | 49/181 |
| 3,611,636 | 10/1971 | Trout | 49/181 |
| 3,789,549 | 2/1974 | Yip | 49/453 X |
| 4,068,406 | 1/1978 | Wood | 49/453 X |
| 4,364,199 | 12/1982 | Johnson et al. | 49/181 |
| 4,718,194 | 1/1988 | Fitzgibbon et al. | 49/181 |
| 4,922,657 | 5/1990 | Foss | 49/181 |
| 4,958,462 | 9/1990 | Cross | 49/181 |

*Primary Examiner*—Philip C. Kannan

*Attorney, Agent, or Firm*—Robert A. Seemann

[57] ABSTRACT

A pivot shoe which slides in a track includes a body which receives a cam. The cam is rotated by a sash pivot shaft for engagement of a wall of the track by the shoe for resisting movement along the track when the sash is rotated on the shaft to a position generally perpendicular to the track. The cam defines a first axial opening for receiving the shaft, and defines a second radial opening for removing the shaft from the cam. The body defines a third radial opening which is in alignment with the second opening when the sash is rotated to the track engaging position. A reversible obstructor for the second opening provides for easy installation or removal of the shaft from the shoe.

9 Claims, 6 Drawing Sheets

PIVOT SHOE FOR REMOVABLE SASH

BACKGROUND OF THE INVENTION

1. Field of the Invention

This invention relates to removable, movable closures, more specifically to a pivot shoe connected by rotation transmission means to a sliding window sash, the shoe being located in the window jamb track for sliding one end of the sash along the track and for preventing sliding by pressing against the track when another end of the sash is rotated away from the track on the pivot shoe.

The shoe provides the option of permitting removal of the sash from the jamb or preventing its removal from the jamb, simultaneously with it preventing sliding of the shoe along the track.

The shoe is necessarily locked against movement in the track when the sash is removed because without the weight of the removed window expressed upon the shoe, the counterbalance mechanism applied to the shoe would case it to fly upwards in the track.

2. Description of the Prior Art.

Locking pivot shoes which permit removal of the sash from the jamb are disclosed in the prior art by many different designs. U.S. Pat. No. 3,611,636, patented Oct. 12, 1971 by D. M. Trout, discloses a shoe having a sharp, cylindrical, rotary, radial cam operated pawl which engages the track for locking the shoe against movement along the track when the window sash is rotated away from the track.

A pivot upon which the window rotates includes a key which removably seats in a notch with radial opening in the rotary locking cam. The cam rotates in a cylindrical bore which comprises a part of the shoe.

. When the sash is vertical, that is, aligned with the track, the notch is oriented horizontally so that the radial opening of the notch is blocked by the inward face of the bore, thereby preventing removal of the key from the shoe.

When the sash is rotated to the horizontal, the cam is rotated 90 degrees by the key so that the opening of the notch is vertical and in alignment with a vertical, axially oriented slot in the bore, as the pawl is forced into locking engagement with the track.

Alignment of the notch with the vertical slot enables the operator to lift the pivot and key out of the notch, up the slot, and out of the shoe. The operator tilts the sash by raising one side and removes it by pulling it out of the jamb while the sash is in an oblique or diagonal position relative to the tracks.

The sash is reinstalled by reversing the above procedure.

U.S. Pat. No. 4,364,199, patented by Johnson et al., Dec. 21, 1982 discloses a shoe which rides in a track having four parallel vertical ribs. The show locates by included slots in the shoe, on the two inner ribs, and as a whole it locates within the two outer ribs.

A pivot upon which the sash rotates includes a key which removably seats in a notch with radial opening, within a rotary cam. The cam rotates in a cylindrical bore with vertically oriented axial slot, which comprises a part of the shoe. The cylindrical bore tangentially intersects the slots.

When the sash is vertical, the notch is oriented horizontally so that the radial opening is blocked by the bore.

When the sash is rotated to the horizontal, the cam is rotated 90 degrees by the key so that it bears radially directly against the two inner ribs of the track, forcing them radially against the portion of the shoe which lies between the inner and outer ribs of the track. Simultaneously with this locking action in the track, the radial opening in the cam lines up with a vertical opening in the bore of the shoe. This permits removal of the sash by lifting the pivot and key out of the notch. Adjacent to the sash, the pivot includes an annular cam face which presses against the track to draw the pivot key back from the base of the track to aid in removal of the sash.

If it is desired to prevent removal of the sash, a plug with depending feet having outwardly extending fingers is provided for blocking the vertical opening in the shoe. It is installed by engaging the fingers in horizontal grooves provided in the walls of the vertical opening in the shoe.

In U.S. Pat. No. 4,718,194, patented Jan. 12, 1988, FitzGibbon et al, discloses a slider body diagonally split at one end. The split inludes a portion shaped to conform to a sash pivot shaft actuated barrel cam when the sash is oriented with the track for sliding. One of the legs established by the split in the slider body includes a pin. The pin is forced radially against an inner face of a side wall of the track when the legs are spread by the radial cam as it rotates with the tilting window.

The cam includes a radial opening, and the slider body includes a vertical opening, whereby the pivot shaft can be lifted vertically from the cam and slider body via the aligned openings when the sash is rotated away from the window frame.

In U.S. Pat. No. 4,922,657, patented May 8, 1990 by R. Foss, the track is bedded in a resilient material so that the sash can be removed by forcing it against one track, therby drawing the pivot pin axially out of the pivot shoe.

The track has three parallel vertical ribs, a first and a third, one on each side of the shoe, and the second one received in a vertical slit in the shoe. A pinch roller rests in an oblong track that is tilted form the vertical so that the roller tends to fall against the second rib, pinching it between the roller and the opposite side of the slit.

The pivot pin, when inserted in the shoe, prevent the roller from falling against the seocnd rib so that the shoe can move freely in the track. When the pin is withdrawn from the shoe, the roller prevents the shoe from sliding in the track.

SUMMARY OF THE INVENTION

It is one object of the invention to provide a locking pivot shoe which optionally permits removal of the sash from the window frame.

It is another object of the invention to provide a locking pivot shoe having a reversible obstructor for preventing removal of the sash from the window frame.

Still another object is to provide in a locking pivot shoe, a reversible obstructor that can be installed or removed while the sash is located in the shoe.

Another object is to provide in a locking pivot shoe of the type described in U.S. Pat. No. 4,958,462, patented Sept. 25, 1990 by Rex D. Cross, an option for removing the sash from the window.

It is another object to provide in the above Cross show with option for removing the sash from the window, a reversible obstructor for preventing removal of the sash from the window frame.

Other objects and advantages will become apparent from the ensuing description of the invention.

In accordance with the invention, the pivot shoe includes a body which defines a passage for receiving a cam that is rotated by an extension of one end of the sash. The other end of the sash can be rotated upon the extension out from the track in which the pivot shoe slides whereupon the cam causes the shoe to lock against the track to resist sliding of the shoe along the track.

The cam rotates about an axis that is generally normal to a first wall of the track. The track comprises opposed second and third walls that are each attached to the first wall, defining a channel for receiving the pivot shoe.

The cam defines a first axial opening for receiving the extension. The cam also defines a second radial opening for removing the extension from the cam.

The body defines a third opening that is arranged in the body so that the second opening is in alignment with the third opening when the shoe is in slide-resisting engagement with an inner face of the track. The alignment of the openings permits removal of the extension from the shoe.

A reversible obstruction means on the body for preventing exit of the extension by way of the second opening, is mounted on the body by clip, piot, or other holding means which is arranged for engaging the obstruction means over the second opening for conversion of the shoe between a shoe that permits and a shoe that does not permit removal of the sash.

The obstruction means is attached to the body outside the third opening for easy removal and installation of the obstruction means on the body while the sash is installed in the shoe.

BRIEF DESCRIPTION OF THE DRAWINGS

In order that the invention will be more fully comprehended, it will now be described, by way of example, with reference to the accompanying drawings, in which.

DESCRIPTION OF THE PREFERRED EMBODIMENTS

Figure 1:
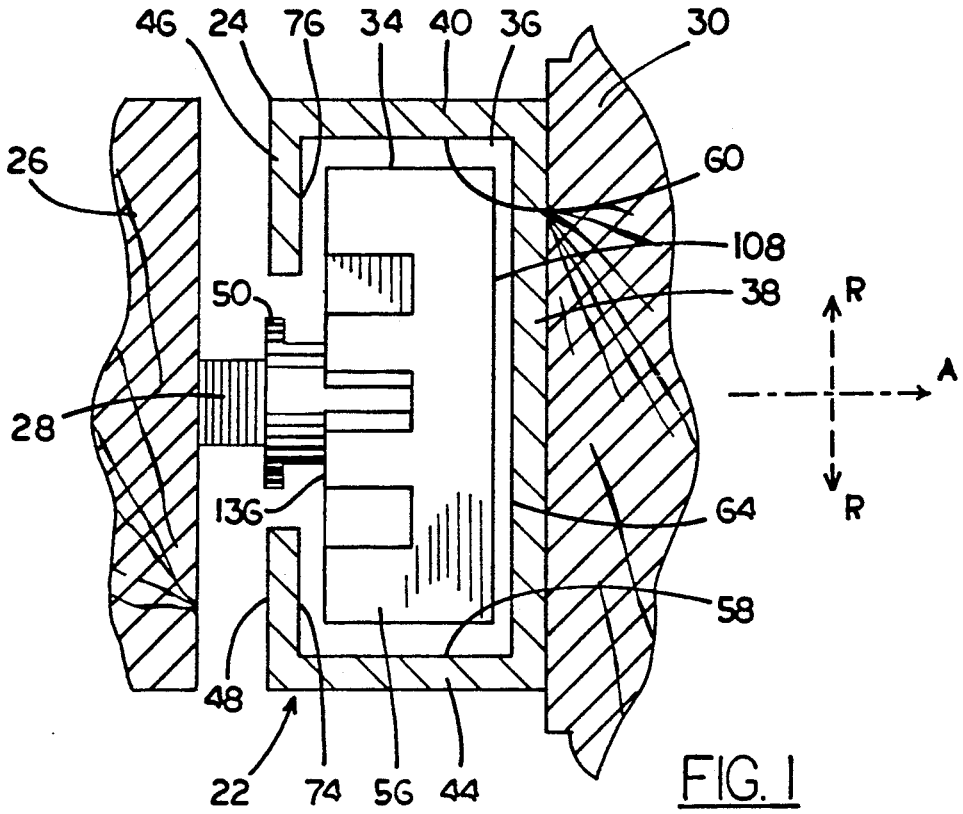
FIG. 1 is a top view of a pivot assembly.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1 of the drawings, window pivot assembly 22 includes track 24 attached to window jamb 30. Sash 26 tilts on pivot shaft 28 so that the sash can be positioned generally coplanar with, or else angled parallel to, the track. While sash 26 is coplanar with the track, it can be slid along the track as it is guided along the track by slider body 34.

Slider body 34 moves within channel 36 which is defined by bottom wall 38, back side wall 40, front side wall 44, back top wall 46 and front top wall 48.

Pivot shaft 28 is received in barrel cam 50 which cams axially (arrow A) and radially (arrow R) for friction locking slider body 34 against movement in channel 36 when sash 26 is tilted away from the plane or longitudinal direction of the track.

The manner of engaging or locking in the track which will be shown in use with the present invention is shown for the purpose of explanation and not necessarily of limitation. It is similar in part of that which is described in U.S. Pat. No. 4,958,462 patented Sept. 25, 1990 by Rex D. Cross.

FIG. 1 shows sash 26 oriented parallel with the track, configured for opening and closing the window by sliding the sash along the track. Slider body 34 has sufficient clearance from the walls for rattle-free guiding of the sash along the track.

Slider body 34 and pivot shaft 28 comprise locking pivot shoe 56.

For purpose of discussion, front side wall 44 is toward the inside of a room, back side wall 40 being toward the outside of the room.

Figure 2:
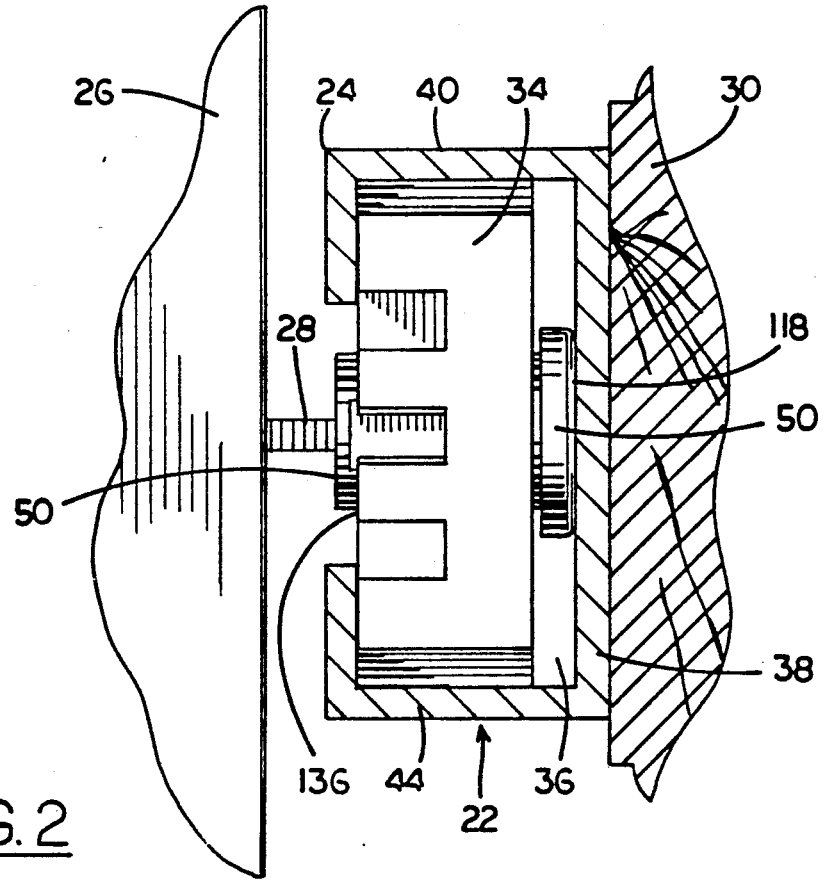
FIG. 2 is a top view of the pivot assembly shown in FIG. 1, with the sash rotated.

FIG. 2 shows sash 26 angled from the parallel with respect to the track. The sash is located at some selected point along the track, and with its center of rotation at pivot shaft 28, sash 26 is tilted into the room. As will be explained in greater detail, barrel cam 50, rotated by pivot shaft 28, radially cams portions of slider body 34 so that it presses against front side wall inner face 58 and back side wall inner face 60, and also cams axially against bottom wall inner face 64, as it axially forces slider body 34 away from bottom wall inner face 64, and toward respective inner faces 74 and 76 of front top wall 48 and back top wall 46.

The angle of tilt by the sash from a parallel with respect to the track, determines the angle of rotation applied to barrel cam 50. The sequence established between the radial and axial camming actions is related to shaping of the various cam faces for operating over predetermined angular ranges of rotation.

Figure 3:
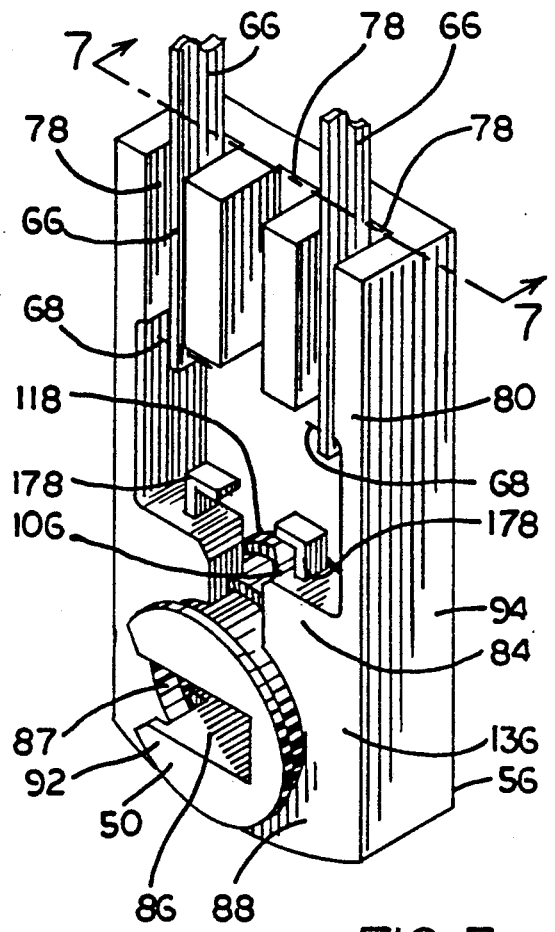
FIG. 3 is a front perspective view of a pivot shoe constructed according to the present invention.

FIG. 3 is a front view of a pivot shoe with cam 50 aligned as if the sash were vertical, or parallel with respect to the track. Slider body 34 which is preferably constructed by molding from a durable and strong but flexible plastic such as Celcon (TM), is designed to receive a spring loaded balance assembly (not shown) which provides lifting force to counterbalance the weight of the sash. Fingers 66 from the balance assembly locate in hook slots 78, and cross pins 68 at the ends of the fingers bridge below the slots for transferring the lifting force via upper bridge portion 80 and lower bridge portion 84, to barrel cam 50.

Shaft slot 86 in top end 92 of cam 50 receives pivot shaft 28, transmitting the lifting force to sash 26 by way of pivot shaft 28.

Pivot shaft 28 can be removed from cam 50 by way of radial opening 87 which falls into alignment with slit opening 98 in slider body 34 when the sash is tilted clockwise to a position that is about 90 degrees from the vertical.

Lower bridge portion 84 is separated by slit 98 into two portions, front portion 88, and back portion 90, on legs 94 and 96 respectively. Legs 94 and 96 can be forced to spread to the full width of channel 36 without breaking, and have a natural tendency to return to neutral by their own resiliency.

Clips 178 provide retention on body 34 for removably mounting obstructive insert 184 which will be described later with respect to FIGS. 11 and 12.

Figure 4:
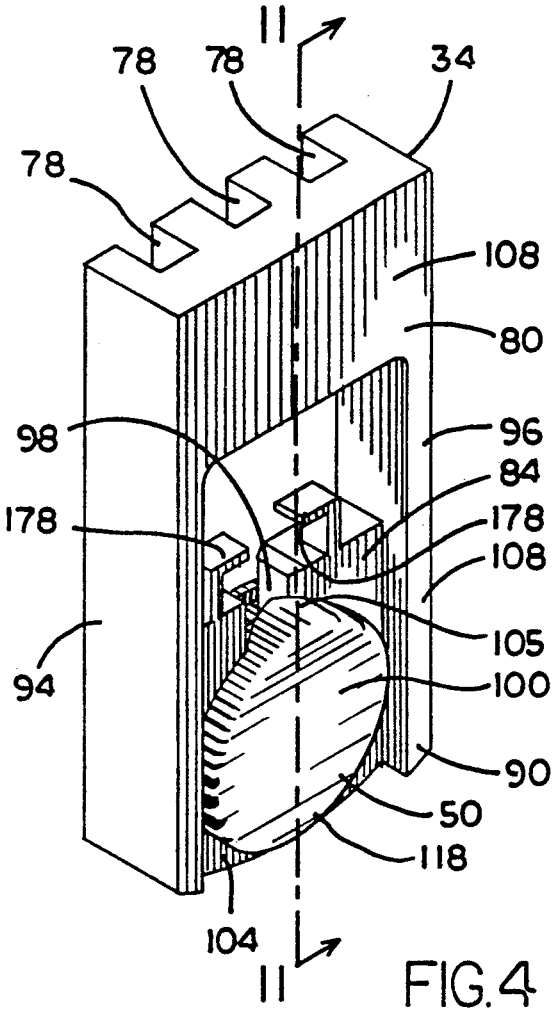
FIG. 4 is a rear perspective view of the pivot shoe.
Figure 6:
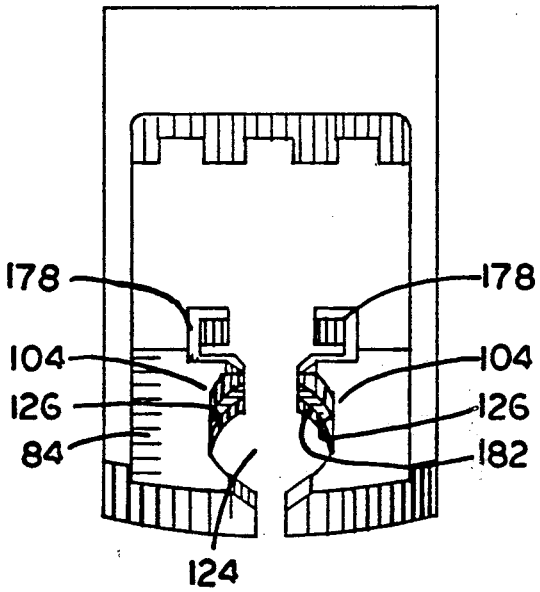
FIG. 6 is a rear perspective view of a pivot shoe body of the invention.
Figure 5:
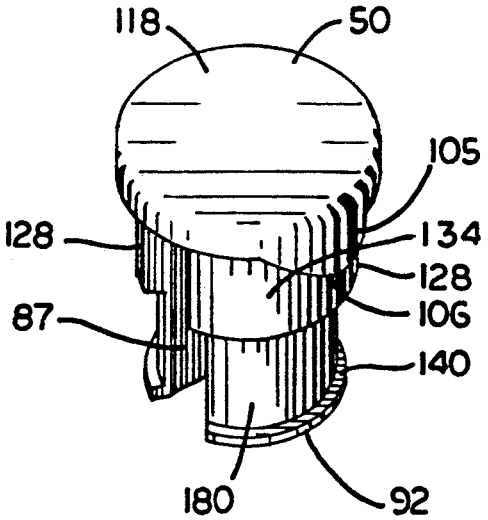
FIG. 5 is a perspective view of a barrel cam of the invention.

As shown in FIG. 4, bottom end 100 of barrel cam 50 is preferably sealed so that the pivot shaft cannot extend beyond the bottom of the cam.

Referring to FIGS. 5, 6, 9 and 10, axial cam surface 104 of lower bridge portion 84 mates with corresponding axial cam surface 106 of axial cam 105 of barrel cam 50 when the sash is coplanar with the track as shown in FIG. 1. The orientation of barrel cam 50 with respect to slider body 34 for this configuration, is as shown in FIGS. 1, 3, 4, 7, 9, 11 and 12. Shaft slot 86 is oriented perpendicular to the longitudinal direction of the track and of balance fingers 66, as shown in FIG. 3. Bottom end 100 of barrel cam 50 is shown in FIG. 4 with the cam rotated to the same angle as it is in FIG. 3. Brake flange 118 does not extend beyond bottom facing surface 108 of the slider body.

Figure 8:
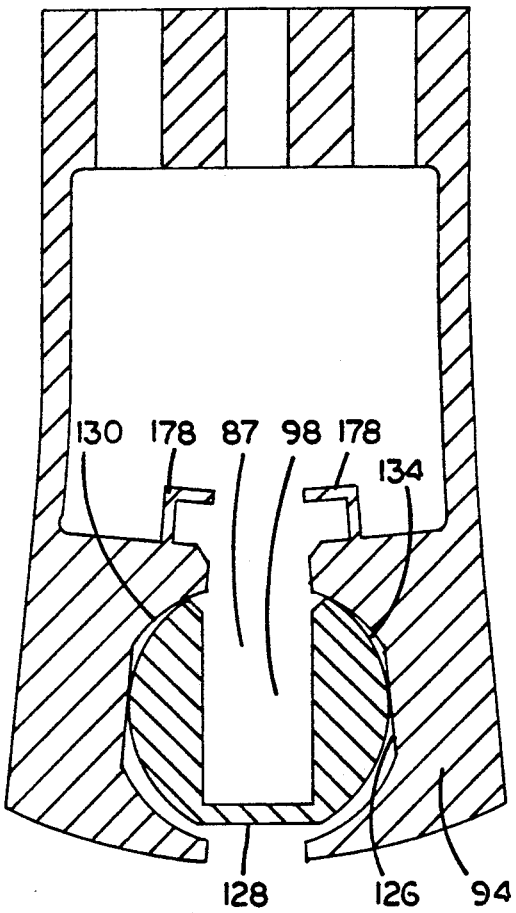
FIG. 8 is a cross sectional view as in FIG. 7, showing the barrel cam rotated to a different angle.
Figure 9:
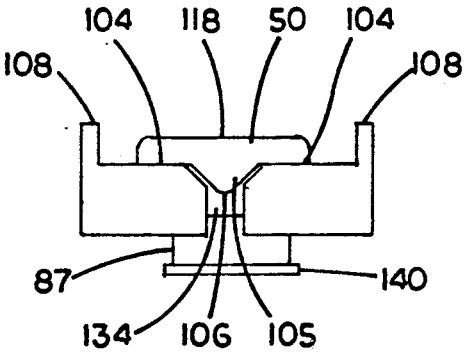
FIG. 9 is a schematic view of one barrel cam axial thrust position.
Figure 10:
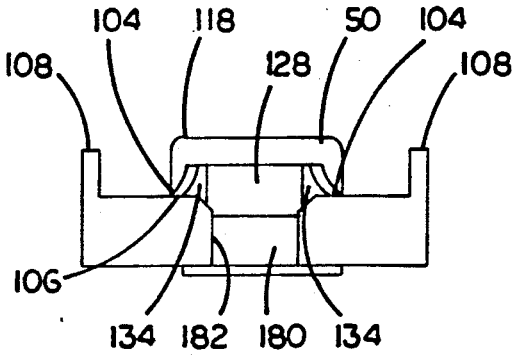
FIG. 10 is a schematic view of one barrel cam axial thrust position.

When the sash is tilted away from the track, pivot shaft 28 rotates barrel cam 50 on its rotary bearing surface 180 within rotary bearing surface 182 of the body, toward the full-tilt orientation represented in FIGS. 2, 8 and 10. As shown in FIG. 10, barrel cam 50 is cammed axially outward from the slider body at some predetermined range of rotation based on the shape of the cam surface, forcing brake flange 118 to extend beyond bottom facing surface 108 of the slider body.

The brake flange of the extended barrel cam bears axially against inner face 64 of the track to help lock slider body 34 in place within the track. Concomitantly, slider body is forced axially in the opposite direction whereupon top facing surface 136 of the slider body presses against front and back top wall inner faces 74 and 76.

Figure 7:
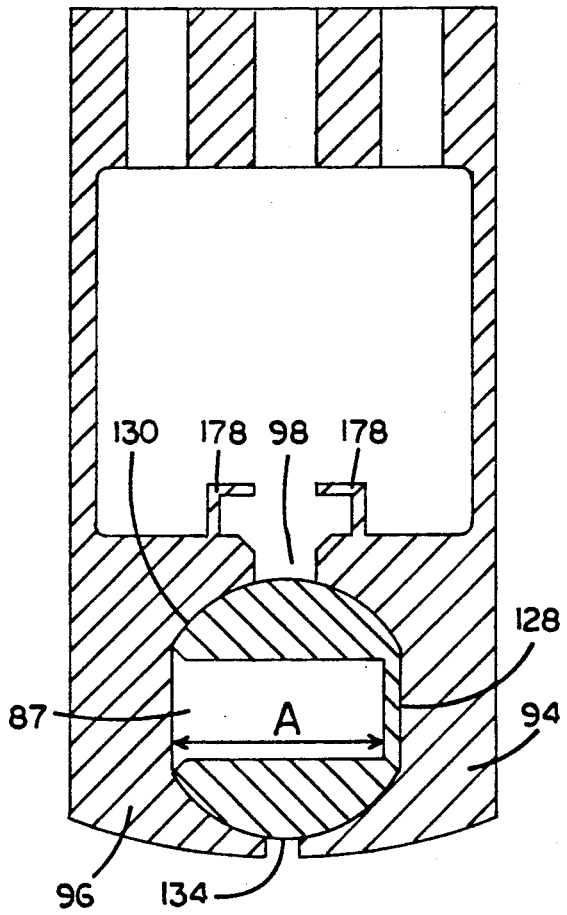
FIG. 7 is a cross sectional view taken along line 7—7 of FIG. 3.

When the sash is coplanar with the track, radially cammed passage 124 through lower bridge portion 84 closely receives barrel cam 50 with flats 126 in alignment with complementary flats 128 on the barrel cam, and with arcs 130 of cammed passage 124 in alignment with complementary arcs 134 on the barrel cam, as shown in FIG. 7.

When the sash is tilted away from the track, arcs 134 cam legs 94 and 96 apart, as shown in FIGS. 8 and 2. The legs are spread to the full width of channel 36 at some predetermined range of rotation of the barrel cam based on the shapes of the involved cam surfaces, and press against front side wall and back side wall inner faces 58 and 60 to help lock slider body 34 within the track.

Assembly of locking pivot shoe 56 is simple. Barrel cam 50 is forced into radially cammed passage 124 through bottom facing surface 108 of the slider body, leading with the shaft slot end of the barrel cam.

Retainer flange 140 on the barrel cam (FIG. 5) resists sliding out of the cam from the body. The retainer flange is not shown on the barrel cam in FIGS. 7 and 8 for clarity of explanation with respect to those figures.

Figure 11:
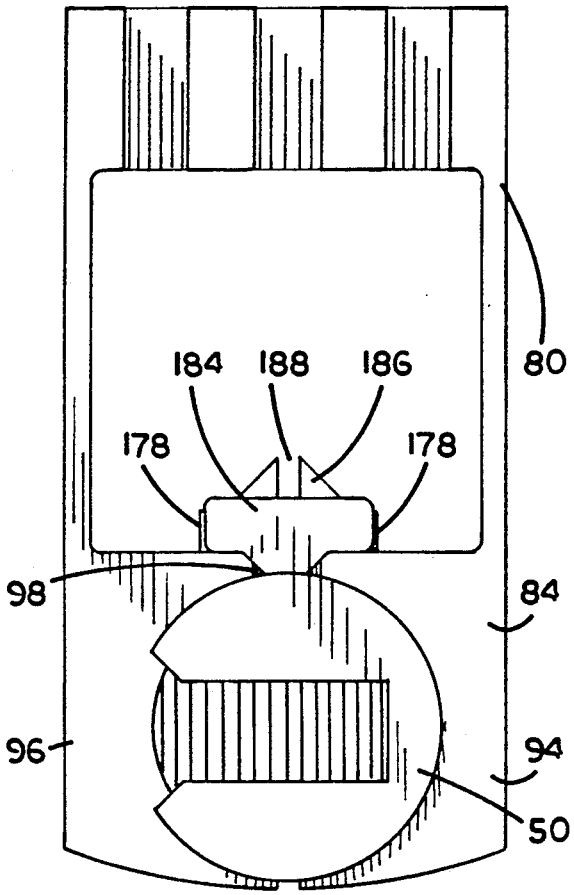
FIG. 11 is a front view of a pivot shoe with an installed obstructive insert.
Figure 12:
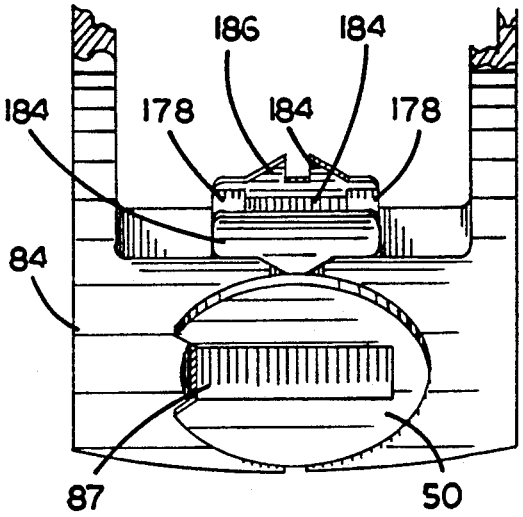
FIG. 12 is an oblique front perspective view of the pivot shoe shown in FIG. 11.
Figure 13:
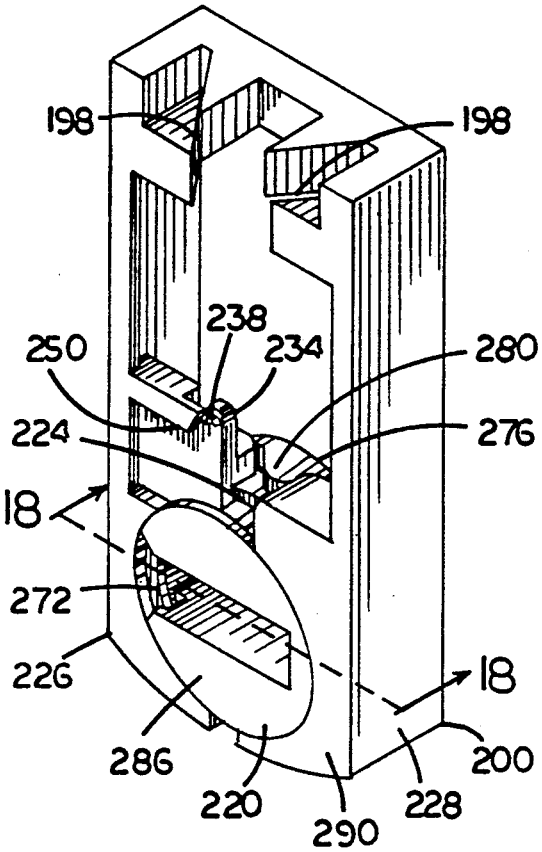
FIG. 13 is a front perspective view of a pivot shoe constructed according to the present invention.
Figure 14:
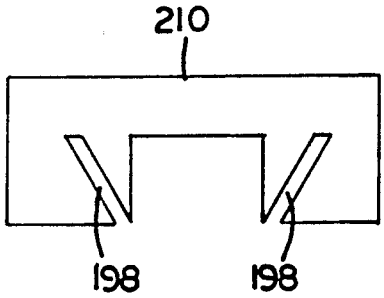
FIG. 14 is an insert for the shoe shown in FIG. 13.

Referring to FIGS. 11 and 12, clips 178, mounted on the body hold obstructive insert 184 which prevents removal of the pivot shaft from cam 50 by way of radial opening 87 and slot 98. The clips extend above the opening of slot 98 and lower bridge portion 84 and toward upper bridge portion 80 so that insert 184 is held at a point that is outside slot 98 for easy removal of the obstruction from the body when the sash is tilted away from the track so that the obstruction provided by insert 184 is reversible. Ears 186 provide easy grip for removing the insert.

When the sash is tilted away from the track, legs 94 and 96 are spread by the cam, resulting in a slight divergence of clips 178. Although clips 178 continue to retain the insert 184, it can then be worked out by manipulation, preferably by inserting a flat blade such as a screwdriver in twist slot 188, and twisting the insert out by rotating the blade. The sash may thus easily be removed by cleaning, repair or replacement by lifting the pivot shaft directly up, out of cam 50 and lower body 84 via opening 87 and slit 98.

Installing the clip is simple. With the shoe cammed into locking position within the track, the pivot shaft is dropped into place within cam 50 via slit 98 and opening 87, then the insert is tilted and slipped at one end under one clip, then the other end of the insert is pressed down until it snaps into place within the clips.

In another preferred embodiment of the present invention, shown in FIGS. 13 through 21, hook slots 198 on slider body 200 receive balance assembly fingers (not shown). The hook slots are reinforced at the underside by flat metallic insert 210 shown in FIG. 14, which has corresponding hook slots 198.

Barrel cam 220 rotates in the region between legs 226 and 228, and cams them apart in an action that is similar to that of barrel cam 50 described earlier.

Figure 15:
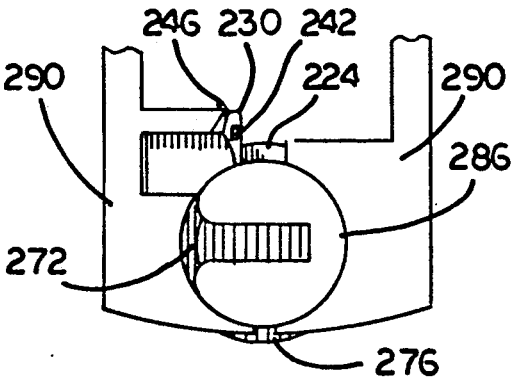
FIG. 15 is front view of a lower portion of the shoe shown in FIG. 13.
Figure 16:
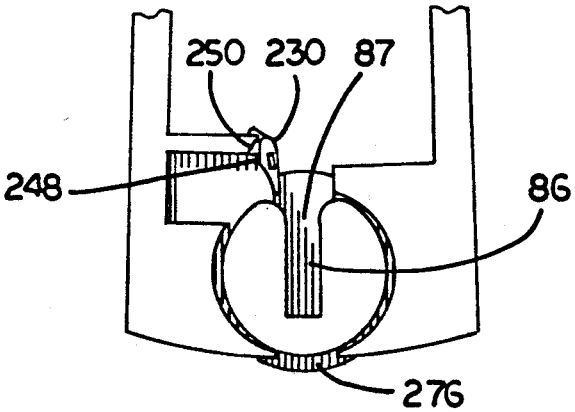
FIG. 16 is a front view as in FIG. 15, showing the barrel cam rotated to a different angle.

Referring to FIGS. 15 and 16, shaft slot 86 receives a pivot shaft for a window as described earlier.

The pivot shaft can be removed from cam 220 by way of radial opening 87 which falls into alignment with opening 224 between the legs when the sash is tilted to a position that is about 90 degrees from the vertical, or from the window track.

Figure 17:
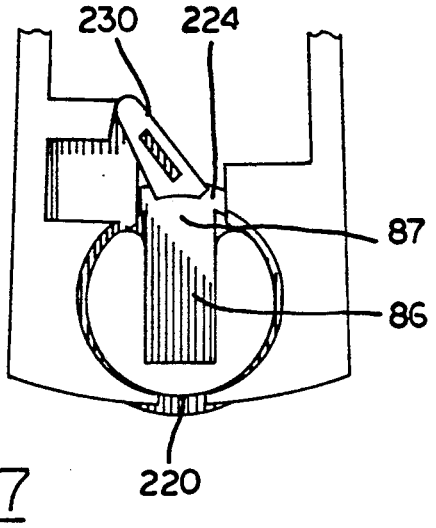
FIg. 17 is a front view as in FIG. 16, showing an obstructive bar engaged to obstruct an opening of the barrel cam.
Figure 18:
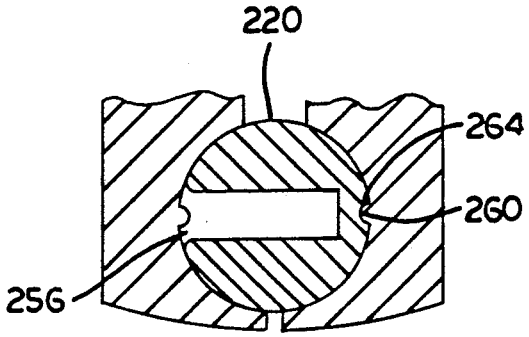
FIG. 18 is a cross section view of a portion of the pivot shoe shown in FIG. 13, taken along line 18—18.
Figure 19:
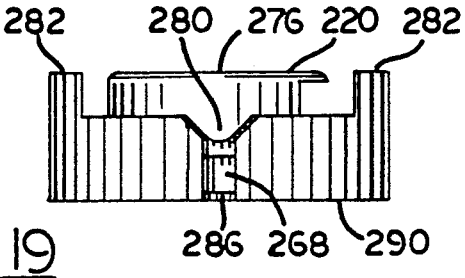
FIG. 19 is a schematic view of one barrel cam axial thrust position.
Figure 21:
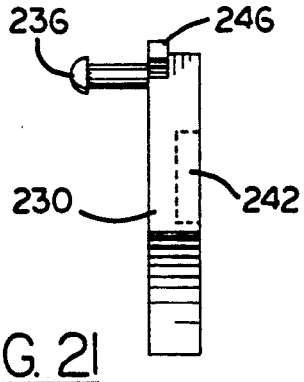
FIG. 21 is a side view of the obstructive bar shown in FIGS. 15, 16 and 17.
Figure 20:
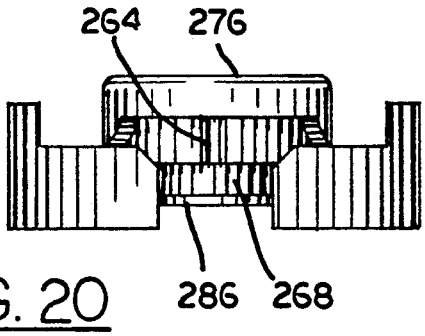
FIG. 20 is a schematic view of one barrel cam axial thrust position.

Obstructive bar 230 is rotatingly mounted on bracket 234 by a snap-in axle 236, shown in FIG. 21, that is inserted in bearing hole 238. Bar 20 can be rotated by means of convenient screw driver blade slot 242 between two positions. In FIG. 17, bar 20 is in an obstructive position, as it is over radial opening 87 of slot 86 in barrel cam 220 to prevent removal of a pivot shaft as described earlier for clip 178. The obstruction is reversed as shown in FIG. 16, where bar 20 is moved out of the way of opening 87.

Tab 246 on bar 230 limits counterclockwise rotation of the bar to that of the obstructive position as the tab moves behind stop 250. Sidewall 248 limits the extent of clockwise rotation by abutting against stop 250.

The selection of reversible obstructor means in the contemplation of the instant invention is not limited to a plug with reversible clip means or pivot bar as described above, but can also be for example a bar or rod that it mounted on the body for sliding over opening 87.

Radially cammed passage 256 is similar to radially cammed passage 124 described earlier. Radial camming action provided with protuberance 260 in concert with axial groove 264 on barrel cam 220 is more abrupt, occurring over a narrower angle of rotation of the barrel cam than the angle of the same activity provided by flat 126 on the radially cammed passage surface of the slider body shown in FIG. 7.

Barrel cam 220 is retained in passage 256 by inward facing ridge 272 of the body which is received in circumferental groove 268 in the barrel cam.

When the sash is vertical, brake flange 276 is below the plane of bottom facing surface 282 of slider body 200. When the sash is rotated to the horizontal, brake flange 276 is cammed up by axial cam 280 to a level above bottom facing surface 282 of slider body 200.

Regardless of the rotary position of the barrel cam, top end 286 of the barrel cam is below top facing surface 290 of slider body 200.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; and pivot shoe comprising:

a body, including a first, a second, and a third side of said body, said first side facing said first inner face, said second side facing said second inner face, and said third side facing said third inner face, said body defining a passage in said body for receiving cam means, cam means, mounted in said passage for rotation by said rotation transmission means about an axis that is generally normal to said first wall, said cam means being for axially engaging the first inner face of said track by said shoe assembly when the pivot shoe is located in the track, for resisting sliding of said pivot shoe along the track when the cam means is rotated over a first angle of a predetermined angular range, said cam means defining a first axial opening in said cam means for receiving said rotation transmission means, and further defining a second radial opening for removing said transmission means from said cam means, and said body defining a third opening arranged in said body so that said second opening is in alignment with said third opening when said shoe is in slide-resisting engagement with the first inner face of said track, for removing said rotation transmission means from said pivot shoe, obstruction means for reversibly preventing exit of said rotation transmission means by way of said second opening, by obstructing said second opening, means for mounting said obstruction means on said body for reversibly setting the obstruction means over said second opening, said mounting means comprising clip means mounted on said body, arranged for setting said obstruction means over said second opening, said clip means being of the type permitting easy removal of said obstruction means from said body, and fingers on said clip means, said fingers being for gripping said obstruction means over said third opening for easy removal of said obstruction means from said clip means when an item is attached by said rotation transmission means to said shoe.

2. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; and pivot shoe comprising:

a body, including a first, a second, and a third side of said body, said first side facing said first inner face, said second side facing said second inner face, and said third side facing said third inner face, said body defining a passage in said body for receiving cam means, cam means, mounted in said passage for rotation by said rotation transmission means about an axis that is generally normal to said first wall, said cam means being for axially engaging the first inner face of said track by said shoe assembly when the pivot shoe is located in the track, for resisting sliding of said pivot shoe along the track when the cam means is rotated over a first angle of a predetermined angular range, said cam means defining a first axial opening in said cam means for receiving said rotation transmission means, and further defining a second radial opening for removing said transmission means from said cam means, said body defining a third opening arranged in said body so that said second opening is in alignment with said third opening when said shoe is in slide-resisting engagement with the first inner face of said track, for removing said rotation transmission means from said pivot shoe, obstruction means for reversibly preventing exit of said rotation transmission means by way of said second opening, by obstructing said second opening, means for mounting said obstruction means on said body for reversibly setting the obstruction means over said second opening, and, said mounting means comprising pivot means.

3. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, said first side facing said first inner face, said second side facing said second inner face, and said third side facing said third inner face, said body defining a passage in the body for receiving cam means, cam means mounted in said passage for rotation by said rotation transmission means about an axis that is generally normal to said first wall, said cam means being for radially engaging said second inner face of said track by said shoe assembly when the pivot shoe is located in the channel, for resisting sliding of said pivot shoe along the track when the cam means is rotated over a first angle of said predetermined angular range, said cam means defining a first axial opening in said cam means for receiving said rotation transmission means, and further, defining a second radial opening for removing said transmission means from said cam means, and said body defining a third opening arranged in said body so that said second opening is in alignment with said third opening when said shoe is in slide-resisting engagement with the second inner face of said track, for removing said rotation transmission means from said pivot shoe, obstruction means for reversibly preventing exit of said rotation transmission means by way of said second opening, by obstructing said second opening, clip means mounted on said body, said clip means being arranged for setting said obstruction means over said second opening, said clip means being of the type permitting easy removal of said obstruction means from said body, fingers on said clip means, said fingers being for gripping said obstruction means over said third opening for easy removal of said obstruction means from said clip means when an item is attached by said rotation transmission means to said shoe.

4. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, and first side facing said first inner face, said second side facing said second inner face, and said third side facing said third inner face, said body defining a passage in the body for receiving cam means, cam means mounted in said passage for rotation by said rotation transmission means about an axis that is generally normal to said first wall, said cam means being for radially engaging said second inner face of said track by said shoe assembly when the pivot shoe is located in the channel, for resisting sliding of said pivot shoe along the track when the cam means is rotated over a first angle of said predetermined angular range, said cam means defining a first axial opening in said cam means for receiving said rotation transmission means, and further defining a second radial opening for removing said transmission means from said cam means, and said body defining a third opening arranged in said body so that said second opening is in alignment with said third opening when said shoe is in slide-resisting engagement with the second inner face of said track, for removing said rotation transmission means from said pivot shoe, obstruction means for reversibly preventing exit of said rotation transmission means by way of said second opening, by obstructing said second opening, and means for mounting said obstruction means on said body for movement of said obstruction means to a position over said second opening and to a position away from over said second opening said means for mounting further retaining said obstruction means on said body in either of said positions.

5. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, said first side facing said first inner face, said second side facing said second inner face, and said third side facing said third inner face, said body defining a passage in said body for receiving cam means, cam means, mounted in said passage for rotation by said rotation transmission means about an axis that is generally normal to said first wall, said cam means being for axially engaging the first inner face of said track by said shoe assembly when the pivot shoe is located in the track, for resisting sliding of said pivot shoe along the track when the cam means is rotated over a first angle of a predetermined angular range, said cam means also being for radially engaging said second inner face of said track by said shoe assembly when the pivot shoe is located in the channel, for resisting sliding of said pivot shoe along the track when the cam means is rotated over a second angle of said predetermined angular range, said cam means defining a first axial opening in said cam means for receiving said rotation transmission means, and further defining a second radial opening for removing said transmission means from said cam means, said body defining a third opening arranged in said body so that said second opening is in alignment with said third opening when said shoe is in slide-resisting engagement with the first inner face of said track, for removing said rotation transmission means from said pivot shoe, obstruction means for reversibly preventing exit of said rotation transmission means by way of said second opening, by obstructing said second opening, means for mounting said obstruction means on said body for reversibly setting the obstruction means over said second opening, said mounting means comprising clip means mounted on said body, arranged for setting said obstruction means over said second opening, said clip means being of the type permitting easy removal of said obstruction means from said body, and fingers on said clip means, said fingers being for gripping said obstruction means over said third opening for easy removal of said obstruction means from said clip means when an item is attached by said rotation transmission means to said shoe.

6. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, said first side facing said first inner face, said second side facing said second inner face, and said third side facing said third inner face, said body defining a passage in said body for receiving cam means, cam means, mounted in said passage for rotation by said rotation transmission means about an axis that is generally normal to said first wall, said cam means being for axially engaging the first inner face of said track by said shoe assembly when the pivot shoe is located in the track, for resisting sliding of said pivot shoe along the track when the cam means is rotated over a first angle of a predetermined angular range, said cam means also being for radially engaging said second inner face of said track by said shoe assembly when the pivot shoe is located in the channel, for resisting sliding of said pivot shoe along the track when the cam means is rotated over a second angle of said predetermined angular range, said cam means defining a first axial opening in said cam means for receiving said rotation transmission means, and further defining a second radial opening for moving said transmission means from said cam means, said body defining a third opening arranged in said body so that said second opening is in alignment with said third opening when said shoe is in slide-resisting engagement with the first inner face of said track, for removing said rotation transmission means from said pivot shoe, and obstruction means for reversibly preventing exit of said rotation transmission means by way of said second opening, by obstructing said second opening, means for mounting said obstruction means on said body for movement of said obstruction means to a position over said second opening and to a position away from over said second opening while retaining said obstruction means on said body.

7. In a pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to and spaced from the second wall and attached to said first wall, said first, second and third walls including first, second and third inner faces respectively which define a channel for receiving the pivot shoe; said pivot shoe comprising:

a body, including a first, a second, and a third side of said body, said first side facing said first inner face, said second side facing said second inner face, and said third side facing said third inner face, said body defining a passage in said body for receiving cam means, cam means, mounted in said passage for rotation by said rotation transmission means about an axis that is generally normal to said first wall, said cam means being for axially engaging the first inner face of said track by said shoe assembly when the pivot shoe is located in the track, for resisting sliding of said pivot shoe along the track when the cam means is rotated over a first angle of a predetermined angular range, said cam means also being for radially engaging said second inner face of said track by said shoe assembly when the pivot shoe is located in the channel, for resisting sliding of said pivot shoe along the track when the cam means is rotated over a second angle of said predetermined angular range, said cam means defining a first axial opening in said cam means for receiving said rotation transmission means, and further defining a second radial opening for removing said transmission means from said cam means, said body defining a third opening arranged in said body so that said second opening is in alignment with said third opening when said shoe is in slide-resisting engagement with the first inner face of said track, for removing said rotation transmission means from said pivot shoe, obstruction means for reversibly preventing exit of said rotation transmission means by way of said second opening, by obstructing said second opening, means for mounting said obstruction means on said body for reversibly setting the obstruction means over said second opening, and said mounting means comprising pivot means.

8. In an improved pivot shoe assembly for sliding an item along a track, rotating the item about an axis that is generally normal to the track, and by said rotation through rotation transmission means to a pivot shoe, locking the pivot shoe at a predetermined location along the track, said track comprising a first wall, a second wall attached to the first wall, a third wall generally opposed to an spaced from the second wall and attached to said first wall, and a fourth wall generally opposed to and spaced from the first wall, and attached to the second and third walls, said first, second, third, and fourth walls including first, second, third, and fourth inner faces respectively which define a channel for receiving the pivot shoe; the improvement comprising:

said pivot shoe comprising a body for simultaneous locking of said shoe against the four inner faces, said body including a first, a second, a third, and a fourth side of said body, a first portion of said body and a second portion of said body, said first side facing said first inner face, said second side facing said second inner face, said third side facing said third inner face, said fourth side facing said fourth inner face, and said first and second portion being oriented longitudinally with the track when said body is located within said track, said first portion comprising;

a first leg and a second leg, said first and second legs defining a separation zone between them for divergent movement of said legs, and further defining between them within said separation zone, a passage in the body for receiving a barrel cam, a barrel cam having a first end and a second end, mounted in said passage for rotation by said rotation transmission means about an axis that is generally normal to said first wall, said barrel cam and said body defining between them an axial thrust cam for forcing said first end away from the first side of said body for engaging the first inner face of said track and for forcing said body into engagement with said fourth inner face of said track when the pivot shoe is located in the channel, for resisting sliding of said pivot shoe along the track when the barrel cam is rotated over a first angle of a predetermined angular range, said axial thrust cam also being for permitting retreat of said first end of said barrel cam from the first inner face of said track and said body from said fourth inner face when the barrel cam is rotated over a second angle of said predetermined angular range, said barrel cam and said first leg defining between them a radial thrust cam for forcing said leg away from the axis of said barrel cam for engaging a one of the second and third inner faces of the track by said first leg and the other of the second and third faces by the body when the pivot shoe is located in the channel, for resisting sliding of said pivot shoe along the track when the barrel cam is rotated over a third angle of said predetermined angular range, said radial thrust cam also being for permitting retreat of said first leg and said body from said engagement with the second and third inner faces of the track when said barrel cam is rotated over a fourth angle of said predetermined angular range, said first and third angles of said predetermined angular range generally coinciding, said barrel cam defining a first axial opening in said cam for receiving said rotation transmission means, and further defining a second radial opening for removing said transmission means from said cam, and said body defining a third opening arranged in said body so that said second opening is in alignment with said third opening when said shoe is in slide-resisting engagement with the first inner face of said track, for removing said rotation transmission means from said pivot shoe.

9. The pivot shoe described in claim 8 further comprising:

obstruction means for reversibly preventing exit of said rotation transmission means by way of said second opening, by obstructing said second opening, and means for mounting said obstruction means on said body for reversibly setting the obstruction means over said second opening.

* * * * *